United States Patent [19]

Wolze

[11] Patent Number: 4,520,696

[45] Date of Patent: Jun. 4, 1985

[54] CHAMPAGNE BOTTLE OPENER

[76] Inventor: Martin H. Wolze, 3007 Hermosa Ave., La Crescenta, Calif. 91214

[21] Appl. No.: 481,735

[22] Filed: Apr. 4, 1983

[51] Int. Cl.[3] ..... B67B 7/00

[52] U.S. Cl. ..... 81/3.55

[58] Field of Search ..... 81/3 R, 3.36, 3.46 R, 81/3.46 A; D8/18, 33, 40

[56] References Cited

U.S. PATENT DOCUMENTS

| | | | |
|---|---|---|---|
| D. 183,483 | 9/1958 | Furey | D8/18 |
| 1,199,272 | 9/1916 | Hutter | 81/3.36 |
| 2,514,565 | 7/1950 | Capriccio | 81/3.46 |
| 2,688,266 | 9/1954 | Knudsen et al. | 81/3 R |
| 2,811,061 | 10/1957 | Radovich | 81/3.36 |
| 4,018,110 | 4/1977 | Spriggs | 81/3.46 R X |
| 4,387,609 | 6/1983 | Polsfuss | 81/3.36 |

*Primary Examiner*—James G. Smith

*Attorney, Agent, or Firm*—John E. Wagner

[57] ABSTRACT

A champagne bottle opener designed to dislodge an overhanging top of closure of the type commonly used to close champagne or sparkling wine bottles. The device includes a handle and a bifurcated working area having a prying surface designed to engage the overhanging edge of the closure and deflect it sideward to begin its removal. In one embodiment the bifurcated working area includes a pair of arms which are spaced a distance greater than the bottle neck diameter and less than the diameter of the wire retaining ring around the neck of a champagne bottle. In another embodiment a single angular arm forms with the handle a recess for receiving the bottle neck. In still another embodiment the arms are bent to conform with the upper surface of the ring of the bottle. In normal use, the sideward movement of the cork is sufficient to cause its dislodgement from its sealed position and it may be easily removed manually or it may pop off in a controlled and predictable manner.

6 Claims, 9 Drawing Figures

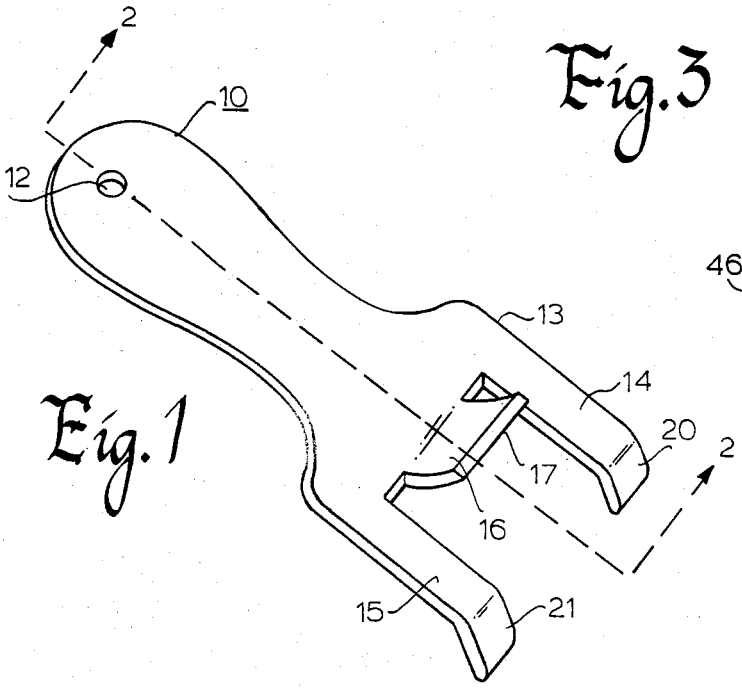
Fig. 1
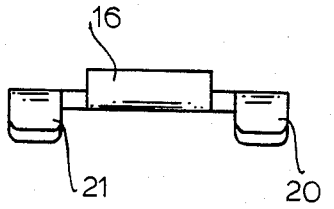
Fig. 3
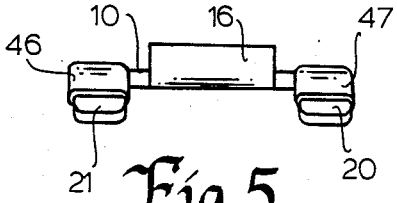
Fig. 5
Fig. 2
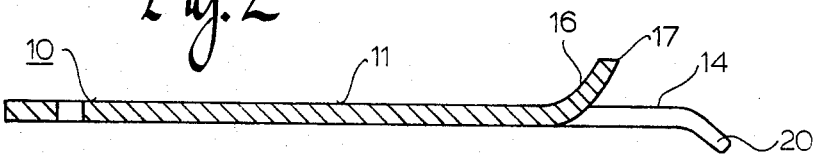
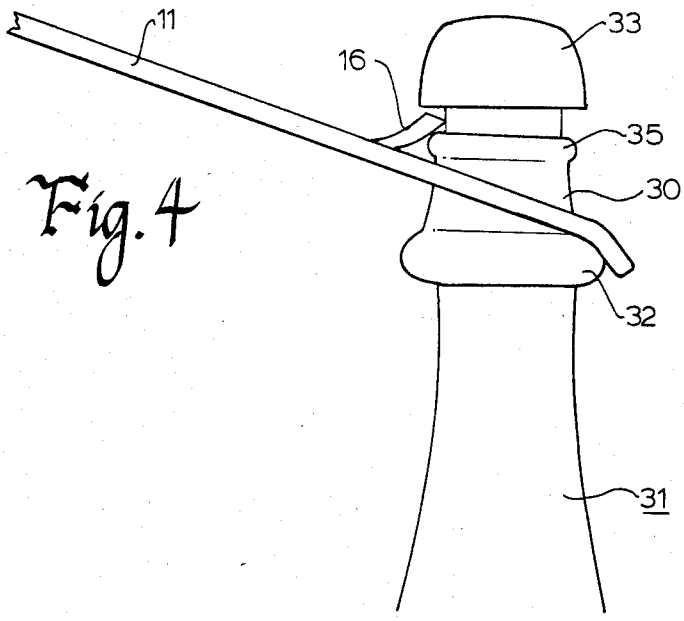
Fig. 4

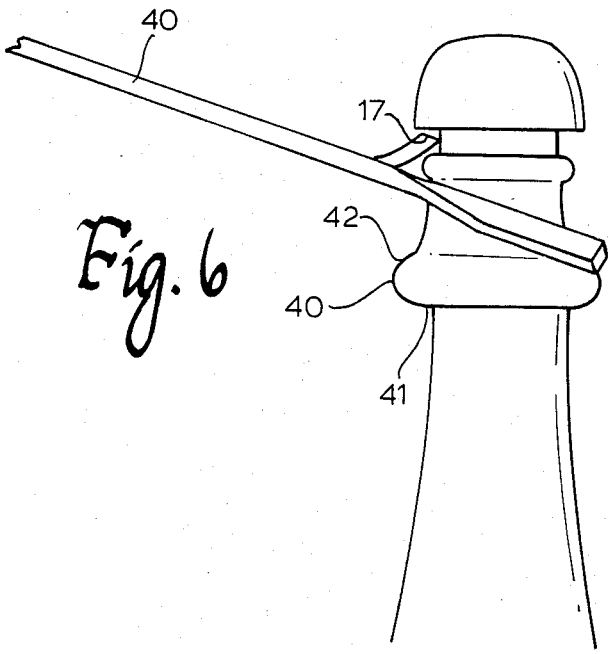
Fig. 6
Fig. 7
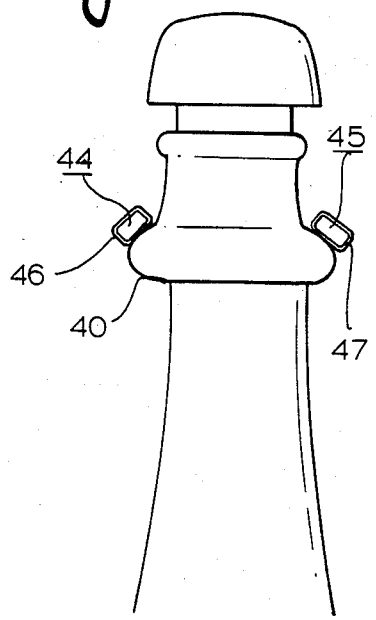
Fig. 9
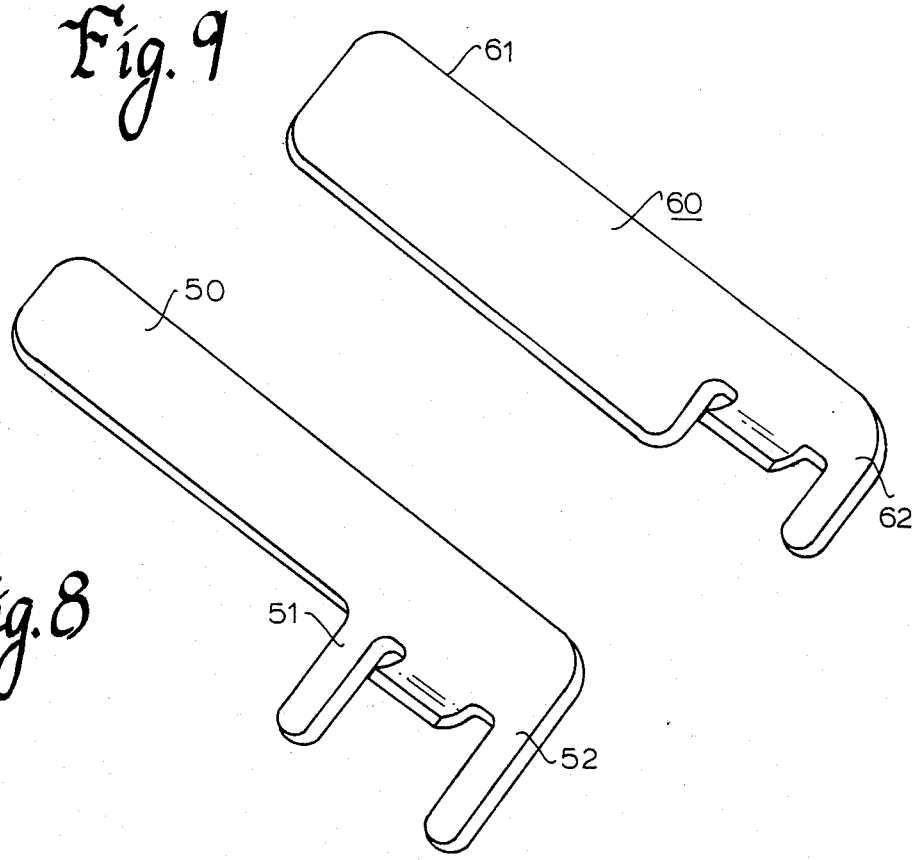
Fig. 8

CHAMPAGNE BOTTLE OPENER

BACKGROUND OF THE INVENTION

The opening of a champagne bottle has long been associated with the celebration of an event, a wedding, a victory or other joyous occasion. The watching of the opening of the champagne bottle is often an important part of the ritual and all too often to the embarrassment of the male who encounters difficulty in breaking the seal of the cork in the neck. The task is virtually never left to a female since they seldom have sufficient strength in their hands to dislodge the cork.

In commercial establishments and at large gatherings catering to such events as wedding receptions, the need exists for rapid opening of a large number of bottles of champagne, nearly simultaneously and often by females. This presents a very real problem, heretofore not solved. The usual result is the opening of the bottles beforehand out of sight and serving champagne which may have sat at room temperature for sometime and lost its vitality. Heretofore to the knowledge of the applicant, there has been no effective opener for champagne bottles.

BRIEF DESCRIPTION OF THE INVENTION

My invention involves a manual champagne bottle opener comprising a handle with a working head and a pair of arms arm which extend forward of the handle, generally parallel to each other and spaced laterally from each other a sufficient distance to allow them to straddle the neck of a champagne bottle above the wire securing ring and to bear downward against that ring. A pair of detents on the arms provide fulcrum points for engaging the neck ring of the bottle.

A pry surface for engaging the overhand of the champagne cork is located between the arms whereby it can bear against the cork and tip it sideward. The pry surface perferably includes a sharpened edge which can either engage the cork or slip between the cork and the lip of the bottle.

In one embodiment, the two arms extend outward from the end of a handle. In another embodiment, the two arms extend generally normal to the length of the handle. In another embodiment, a single "L" shaped arm cooperates with the end region of the handle to act as the two arms. In the case of the first two embodiments the cork is released by upward pivoting of the opener while holding the neck of the champagne bottle. In the third embodiment, the cork is removed by a sideward twisting of the handle.

BRIEF DESCRIPTION OF THE DRAWING

This invention may be more easily understood from the following detailed description and by reference to the drawing in which:

FIG. 1 is a perspective of one embodiment of this invention;

FIG. 2 is a side sectional view of the embodiment of this invention of FIG. 1 taken along line 2—2 of FIG. 1;

FIG. 3 is a front elevational view of the embodiment of FIG. 1;

FIG. 4 is a side elevational view of this invention in use on a champagne bottle with the foil cover and wire cork restraining cage removed;

FIG. 5 is a front elevational view of the embodiment of FIG. 1 with protective covers thereon;

FIG. 6 is a side elevational view of an alternate embodiment of this invention having curved arms and shown in use;

FIG. 7 is a front elevational view of the embodiment of FIG. 6, also in use;

FIG. 8 is a perspective view of a third embodiment of this invention; and

FIG. 9 is a perspective view of a fourth embodiment of this invention.

DETAILED DESCRIPTION OF THE INVENTION

Now referring to FIGS. 1, 2 and 4, a champagne bottle opener 10 in accordance with this invention may be seen as including a handle portion 11 having an opening 12 for hanging the opener when not in use and a working end portion 13 made up of basically three parts, a pair of arms 14 and 15 and a central pry surface 16. Each of the arms have an end bend 20 and 21, respectively which act as fulcrum points when the opener 10 is in use.

The arms 14 and 15 are spaced a sufficient distance apart that they will embrace the neck 30 of a champagne bottle 31, shown in FIG. 4, above the neck ring 32 which is used to hold the wire cage (unshown) for holding cork 33 in place. The arms 14 and 15 are separated by a distance less than the diameter of the neck ring 32 of the bottle 31 of FIG. 2.

The pry surface 16 comprises an upward bent broad surface having an edge 17 of sufficient sharpness to engage the portion of cork 33 extending above the lip 35 of bottle 31. The details of this engagement may be seen in FIG. 4 with the foil and wire cage removed. The edge 17 also may slip between the cork 33 and the lip 35 and apply direct local upward force on the edge of the cork 33 to break its seal and allow it to be deflected upward and sideward for either spontaneous "popping" or easy hand removal. The thumb of the hand holding the opener may be placed over the top of the cork for safety on opening. When the edge 17 engages the cork itself, it has sufficient engagement to prevent unwanted cork popping and allows the user to first unseat the cork by an upward stroke and then release the bottle with his other hand and remove the cork in a controlled manner. This technique is particularly useful in the commercial or large party situation.

The relative positions of the arms 14 and 15, the bent ends 20 and 21 and the pry surface 16 may be seen by reference to FIGS. 2 and 3 . FIG. 2 also illustrates that in the preferred embodiment, the opener 10 is a unitary metal device, formed for example from one-eighth inch cold rolled steel. The opener 10 may be electroplated or have other surface treatment. Using cold rolled steel, the edge 17 may be hardened if desired to provide an edge which will clearly cut into either cork or plastic closures to insure a non-slip engagement with the cork while it is being removed. The edge 17 is at least partially protected by the arms 14 and 15. The handle 11 may also include overlying and underlying wood, bone or other types of conventional kitchen handle material to provide a more comfortable grip. This is particularly valuable when the opener is used commercially for repetitive opening and at a rapid rate.

In the embodiment of FIGS. 6 and 7, the opener 40 is particularly designed for use with champagne bottles which have tapered neck rings. Note that the ring 40 has a planar lower surface 41 and a tapered upper surface 42 which is not ideal as a fulcrum with the embodiment of FIG. 1. Therefore, I have produced the alternate embodiment of FIGS. 6 and 7 in which the arms 44 and 45 are bent outward to match the taper of the bottle neck ring 40. To further improve the opener 40, the arms 44 and 45 of the opener 40 each carry a sleeve 46 and 47 of resilient friction material such as vinyl tubing which extends over the arms 44 and 45. The protective sleeves 46 and 47 may be simply tubing as shown in the drawing or may adhere to the opener as the result of dip coating. The protective coating should not extend to the edge 17.

The opener of this invention need not operate by lifting as in the embodiments so far described. Side directional operating openers are illustrated in FIGS. 8 and 9. In the embodiment of FIG. 8, the opener 50 includes two side extending arms 51 and 52, again spaced less than the neck ring diameter apart and greater than the diameter of the neck of a champagne bottle. The opener 50 is slipped on to the bottle from the side and the handle twisted, to engage the cork or closure with the edge 53. This side opening may be preferred by some users.

Another side opening embodiment appears in FIG. 9. In this embodiment opener 60 employs its handle portion 61 as one of the arms and incorporates a C shaped arm 62 which includes the pry surface 63 as a part of its upper arm portion. In the embodiment of FIG. 9, opening is again accomplished by a sideward twist of the handle 61.

In each of the foregoing embodiments, a champagne cork may be easily and reliably removed without the need to use one's thumbs in the traditional manner. Bottles may be opened faster and with less strain on the user. Champagne bottles may now be easily opened by those with lesser strength in their hands and with better control than heretofore.

The above described embodiments are merely illustrative of this invention and are not limiting of the scope thereof. Rather, this invention is defined by the following claims and their equivalents.

I claim:

1. A champagne bottle opener comprising:

a unitary body including a handle portion and a working head portion, said working handle portion including at least one arm extending from said handle and defining with the body a recess of width less than the diameter of the neck ring of a champagne bottle;

said arm including an end bend for engaging the neck ring of the bottle and constituting a fulcrum point when opening said opener including a pry surface positioned within said recess and including an edge of sufficient sharpness to engage a portion of the cork;

whereby a cork may be removed from a champagne bottle by the application of downward pressure by the arm against the neck ring of the bottle and upward pressure against the cork by the edge of the pry portion.

2. The combination in accordance with claim 1 including a second arm defining said recess with said one arm, each arm including end bends.

3. The combination in accordance with claim 2 wherein the ends of said arms depend downward.

4. The combination in accordance with claim 2 wherein said opener is generally planar and said arms are bent from the plane of the opener, each of said arms bent oppositely whereby said arms generally conform to the taper of the bottle having tapered neck rings.

5. The combination in accordance with claim 2 including resilient cover means on said arms in the region of arms which engage the neck ring of the bottle.

6. The combination in accordance with claim 2 in which said arms extend sideward from the length of said handle portion whereby the champagne bottle is opened by twisting said handle.

* * * * *